US012325963B1

(12) United States Patent
Price et al.

(10) Patent No.: US 12,325,963 B1
(45) Date of Patent: Jun. 10, 2025

(54) ATTACHMENT DEVICE FOR FLOOR SHAVING SYSTEMS

(71) Applicants: Andrew Anson Price, Apopka, FL (US); James Franklin Price, III, Longwood, FL (US)

(72) Inventors: Andrew Anson Price, Apopka, FL (US); James Franklin Price, III, Longwood, FL (US)

( * ) Notice: Subject to any disclaimer, the term of this patent is extended or adjusted under 35 U.S.C. 154(b) by 0 days.

(21) Appl. No.: 19/012,349

(22) Filed: Jan. 7, 2025

Related U.S. Application Data

(63) Continuation of application No. 18/601,400, filed on Mar. 11, 2024, now Pat. No. 12,227,908.

(51) Int. Cl.
*A47L 13/02* (2006.01)
*E01C 23/09* (2006.01)

(52) U.S. Cl.
CPC ..... *E01C 23/0913* (2013.01); *A47L 13/02* (2013.01)

(58) Field of Classification Search
CPC ..... E01C 23/0913; E04G 23/006; A47L 13/02
See application file for complete search history.

(56) References Cited

U.S. PATENT DOCUMENTS 1,804,498 A 5/1931 Doty
2,519,138 A 8/1950 Katz
4,683,657 A * 8/1987 Anderson ..... B26D 11/00 15/93.1
5,647,641 A 7/1997 Sulosky et al.
6,086,160 A 7/2000 Bitelli
6,343,981 B1 2/2002 Buchanan
6,540,305 B2 4/2003 Phillips
7,192,095 B2 3/2007 Sansone et al.
7,325,625 B1 2/2008 Winters
7,603,780 B2 * 10/2009 Oikarinen ..... B25G 1/06 30/340
7,712,839 B1 5/2010 Chen
8,911,024 B2 12/2014 Fundakowski et al.
8,950,821 B2 2/2015 Fundakowski et al.
10,011,105 B2 * 7/2018 May ..... B32B 43/006
10,329,782 B1 * 6/2019 Burk ..... B26D 3/28
10,619,365 B2 * 4/2020 Anderson ..... E04G 23/006
10,689,867 B2 6/2020 King, Jr.
10,941,529 B1 * 3/2021 Bigham ..... A47L 13/02
D1,050,205 S * 11/2024 Price ..... E01C 23/0913 D15/126
12,227,908 B1 * 2/2025 Price ..... E01C 23/0913
2015/0086261 A1 3/2015 Trivette
2015/0252569 A1 9/2015 Warshaw
2022/0341105 A1 10/2022 Wachsmann et al.

* cited by examiner

*Primary Examiner* — Gary S Hartmann
(74) *Attorney, Agent, or Firm* — Jason T. Daniel, Esq.; Daniel Law Offices, P.A.

(57) ABSTRACT

An attachment device for floor shaving systems includes a machine mounting coupler and a joint that connects the mounting coupler to a tool receptacle. A receiving block is configured to engage the mounting coupler and an inside edge of a tool receiver of a floor scraping machine to secure the mounting coupler to the floor scraping machine.

13 Claims, 7 Drawing Sheets

ATTACHMENT DEVICE FOR FLOOR SHAVING SYSTEMS

CROSS-REFERENCE TO RELATED APPLICATIONS

This application is a continuation-in-part to and claims the benefit of U.S. application Ser. No. 18/601,400 filed on Mar. 11, 2024, the contents of which are incorporated herein by reference.

TECHNICAL FIELD

The present invention relates generally to floor treatment systems, and more particularly to a blade attachment device for floor shaving systems.

BACKGROUND

The statements in this section merely provide background information related to the present disclosure and may not constitute prior art.

Large commercial buildings such as convention centers, warehouses, and factories, for example, are built with concrete floors that can span large areas of space. In order to prevent uncontrolled cracking in the concrete, a series of expansion joints are cut into the slabs. These joints are typically about ⅛" wide and about 1.5 inches deep, and function to permit thermal expansion and contraction of the concrete, and to account for settling that occurs due to temperature or moisture conditions.

However, these joints cannot remain open to the elements, as this would be an entry point for groundwater and insects, among other issues. For this reason, builders utilize a filling agent such as polyurea, for example, within the expansion joints that can accommodate the natural movement of the concrete and waterproof the same. In normal practice, the joints are overfilled with the material, and, upon drying, workers must then shave the excess material from the joints to ensure they are completely level with the surrounding concrete.

In large buildings, the process of shaving and removing the excess polyurea is typically performed using a self-propelled machine having a scraping tool along the front end. The machine operates whereby the tool engages the end of a single expansion joint and continues along the length of the joint in a single continuous motion to remove the material. Although these machines are typically equipped with hydraulics to raise and lower the scraping tool, they do not permit variations in the orientation of the scraping tool blade itself relative to the machine. As such, these machines are designed to position the edge of the shaving blade directly perpendicular to the direction the machine is moving in order to allow the elongated edge of the blade to engage the polyurea while the mass of the machine and the drive system imparts a force sufficient to shave and remove the excess material located above the surface of the concrete.

Although this process works well for shaving a continuous joint in a straight line, the problem arises at intersections where different joints meet at different (typically perpendicular) orientations. In these situations, the scraping tool cannot engage the perpendicularly oriented material as the force resulting from the blade engaging the material along its entire length would buckle and damage the concrete bounded by the joint and ruin the intersection. As such, each time the machine encounters an intersection (typically every 13 feet or so) the user must stop and reposition the machine at an angle in order to engage the material at the intersection diagonally. Once done, the user can then realign the machine with the first joint and continuing along the length of the joint to remove the remaining material. Such a process is extremely time-consuming and therefore adds considerable cost to the project bid.

In addition to the above, some buildings are constructed with floors having different inclines and/or floor sections that are at different angles to each other. In these instances, using scraping machines is difficult or impossible due to the inability to change the orientation of the scraping tool to match the changes in the orientation of the floor.

Accordingly, it would be beneficial to provide an attachment device for floor shaving systems that can reduce or eliminate the drawbacks noted above.

SUMMARY OF THE INVENTION

The present invention is directed to an attachment device for floor shaving systems. One embodiment of the present invention can include a machine mounting coupler and a tool receptacle that are joined at a compound angle so as to position a scraping tool off the center axis of a scraping machine using the device to remove filler from concrete expansion joints.

In one embodiment, the mounting coupler can be constructed from a solid steel bar having a shape and a size that is complementary to the tool receiver of a scraping machine. The coupler can include a mounting hole and can be secured within the receiver via a mounting pin. In one embodiment, the receptacle can be constructed from steel and can include a hollow channel and an opening. A magnet can be positioned within the receptacle and the shaft of a scraping tool can be inserted within the channel and held in place via the magnet.

The mounting coupler and tool receptacle can be joined at a preferred angle of 11 degrees to permit the blade of the tool to engage expansion joint intersections diagonally to prevent damage to concrete. When positioned within the receptacle, the tool can rotate 360 degrees relative to the device to engage joints at varying angles.

In one embodiment, a receiving block is removably connected to the first end of the mounting coupler and can secure the coupler to the shaving machine.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
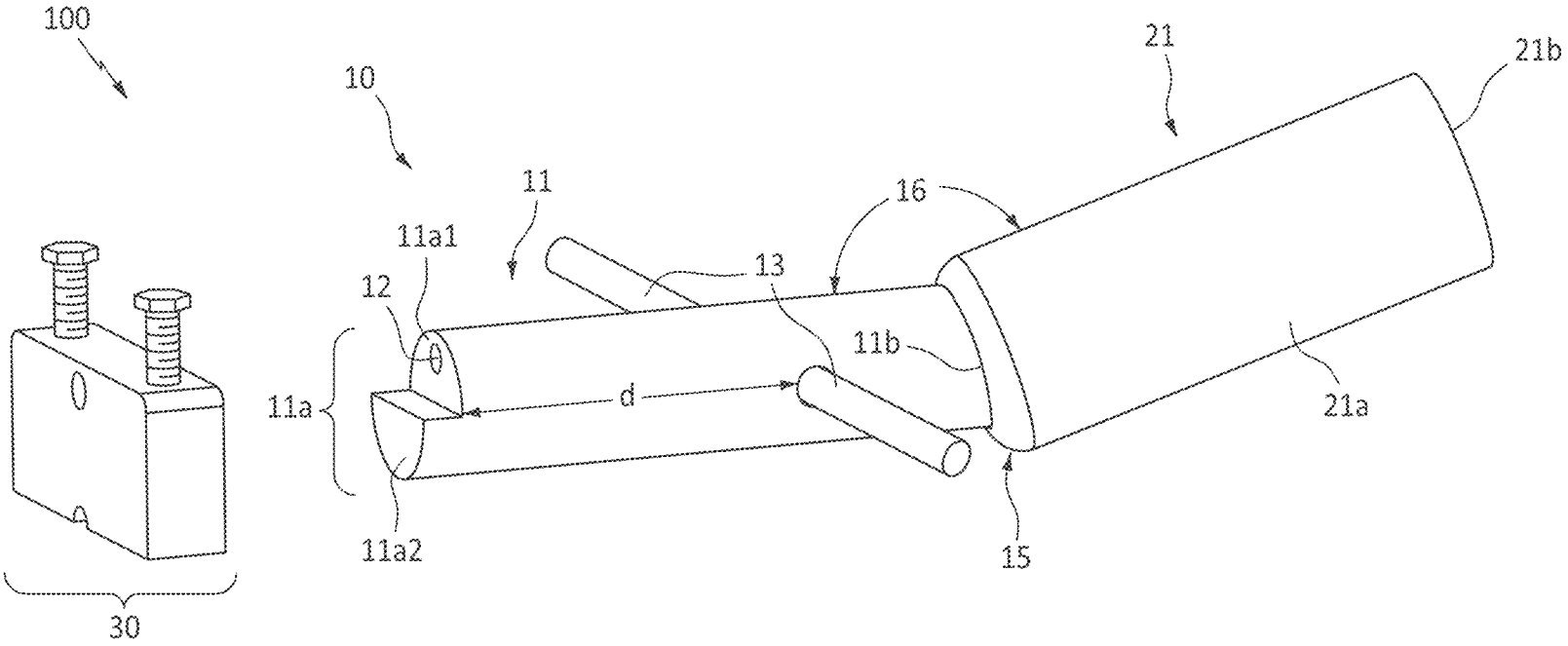
FIG. 1 is a perspective view of an attachment device for floor shaving systems that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

FIGS. 1-7 illustrate one embodiment of a floor shaving attachment device 100 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in FIG. 1, one embodiment of the floor shaving attachment device 100 can include a main body 10 and a receiving block 30. In one embodiment, the main body 10 can include a machine mounting coupler 11 and a tool receptacle 21 which can function to secure a scraping tool 5 in front of, and at a compound angle relative to, a floor scraping machine 1. One suitable example of a floor scraping machine includes the model 5600 Panther rip-up machine that is commercially available from National Flooring Equipment®, for example. Of course, any number of other machines and tools may be utilized with the inventive device.

In one embodiment, the machine mounting coupler 11 can be constructed from a single piece of solid steel round bar having a first end 11*a* and a second end 11*b*. As shown best at FIG. 1, the first end of the coupler 11*a* can include a recessed section 11*a*1, a protruding section 11*a*2, and a threaded aperture 12 for engaging the below described receiving block 30. Additionally, a pair of fixed pins 13 can extend outward from the coupler 11.

In the preferred embodiment, the coupler 11 will include a shape and size (e.g., outer dimension) that is complementary to the shape and size of the blade receiver 1*a* on the scraping machine 1 so as to permit the first end 11*a* to be positioned therethrough to engage the receiving block. Additionally, the pins 13 can be positioned a distance d from the first end 11 that is complementary to the length of the blade receiver 1*a*.

In one embodiment, the scraping tool receptacle 21 can be constructed from steel round bar and can include a first end 21*a* and a second end 21*b*. The mounting coupler 11 and scraping tool receptacle 21 can be connected 15 at an angle 16 relative to each other. After extensive testing and research, the preferred rotational angle is eleven degrees.

This angle was specifically chosen as the preferred angle for allowing the device to scrape filling agents such as polyurea from intersecting expansion joints 1) without damaging the blade due to offset angular forces, and 2) without buckling and damaging the concrete at the intersecting joints, while allowing the machine 1 to operate normally (e.g., without reducing hydraulic or drive power). However, other angles between about 10 degrees and 30 degrees, for example, are also contemplated.

Figure 2:
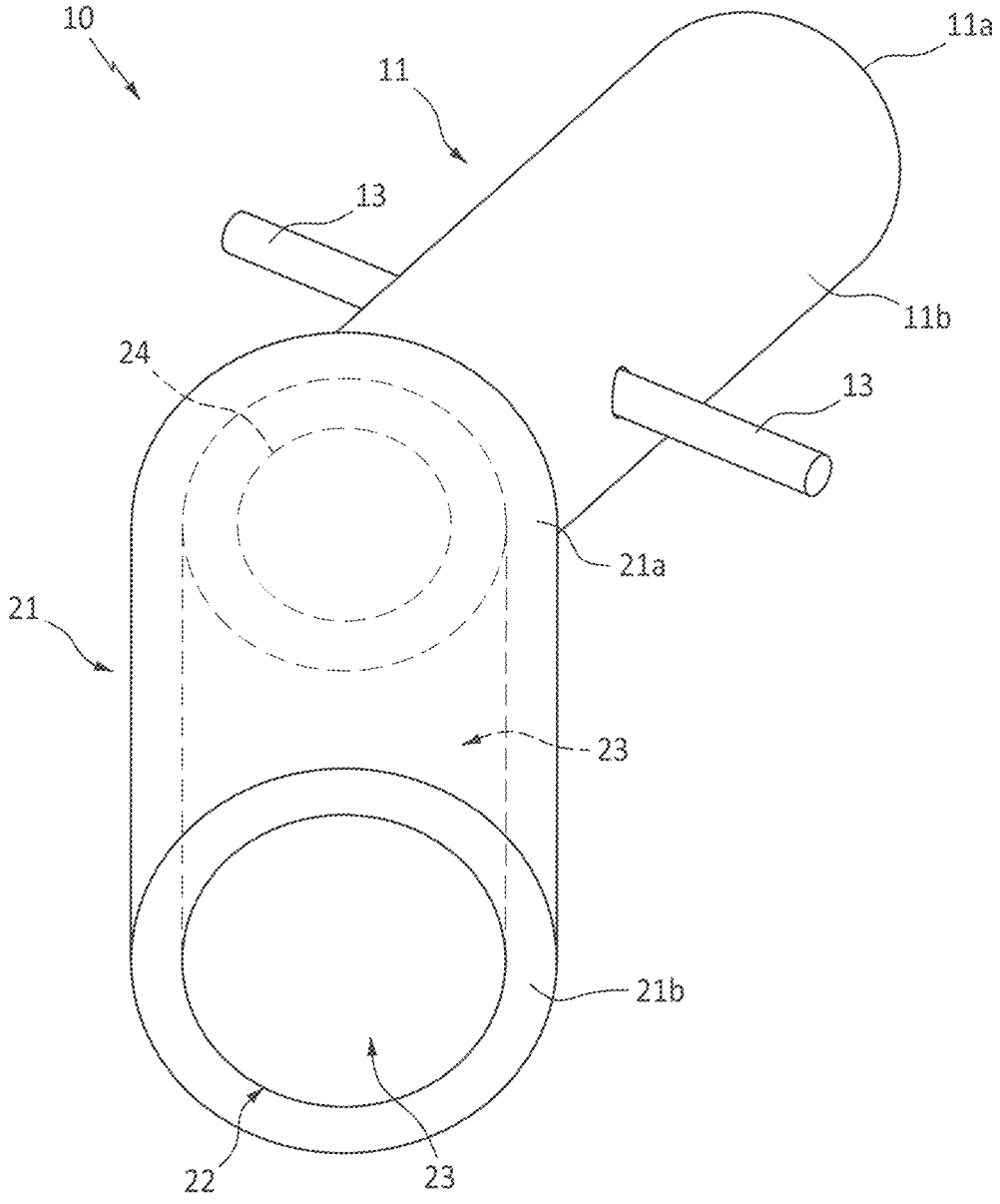
FIG. 2 is an end view of the main body of the attachment device for floor shaving systems in accordance with one embodiment of the invention.

As shown best at FIG. 2, the receptacle 21 can include an opening 22 along the second end 21*b*, and a hollow channel 23 can extend from the opening toward the first end 21*a*. In the preferred embodiment, a magnet 24 can be positioned within the channel at the end opposite to the opening. The channel 24 can include a shape and a size that is complementary to the shape and size of the shaft 5*a* of the scraping tool 5, so as to allow the same to be slidingly positioned within the channel. When so positioned, the magnet 24 can maintain the tool within the channel. Moreover, because the tool is engaged by the magnet, the device advantageously allows the tool to rotate 360 degrees relative to the device.

In the preferred embodiment, the mounting coupler 11 and the tool receptacle 21 will be connected 15 via welding, so as to result in a unitary component. Although described above with regard to specific construction materials, other embodiments are contemplated. For example, the steel components may be coated in Zinc or other materials, and/or the components themselves may be constructed from any number of other rigid and extremely high strength materials such as metallic alloys, cast iron or composites, for example, that are capable of withstanding compressive and tortional forces of several thousand pounds.

Figure 3B:
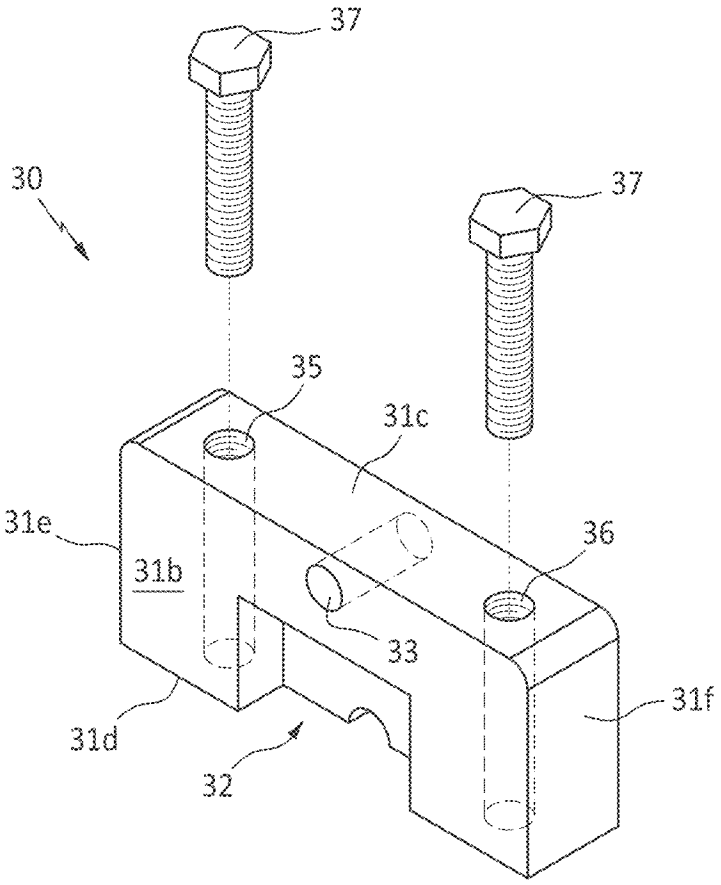
FIG. 3B is a back view of the mounting block of the attachment device for floor shaving systems in accordance with one embodiment of the invention.
Figure 3A:
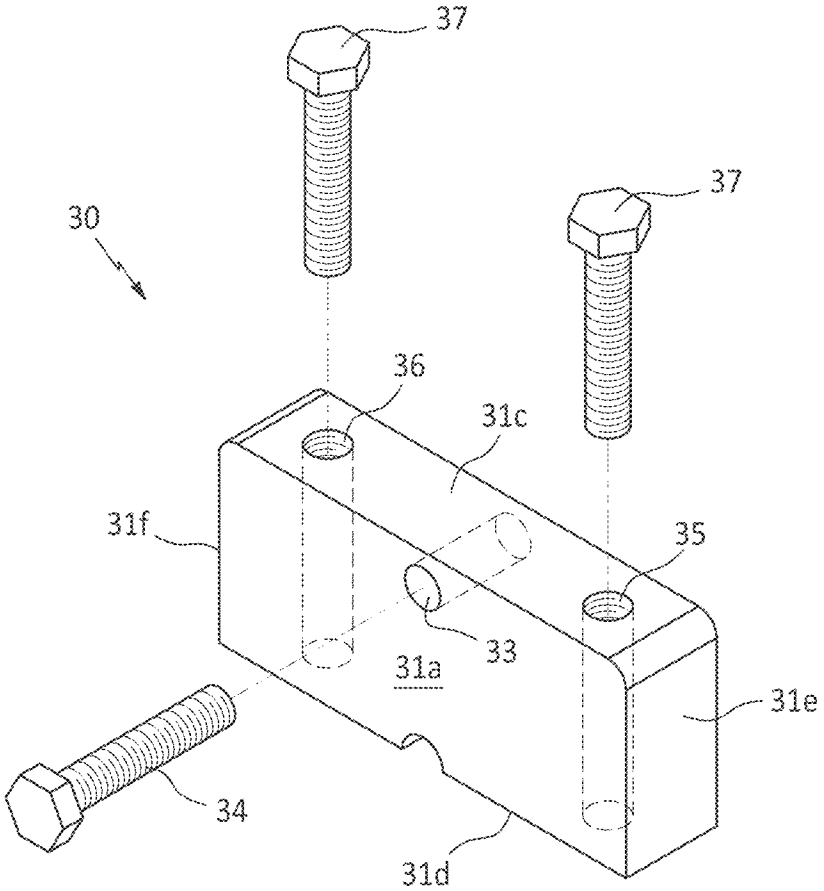
FIG. 3A is a front view of the mounting block of the attachment device for floor shaving systems in accordance with one embodiment of the invention.
Figure 4:
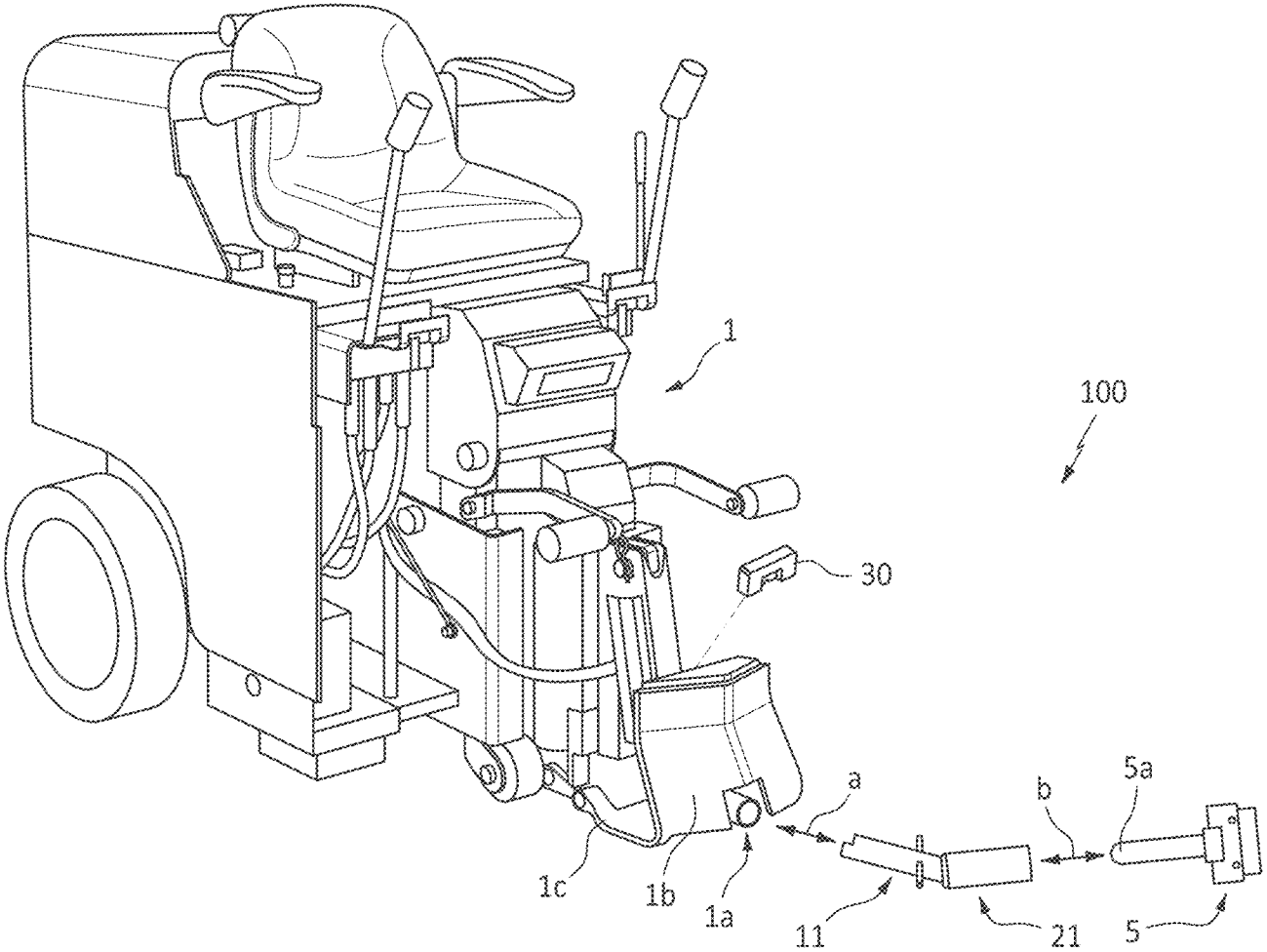
FIG. 4 is a perspective view of the attachment device for floor shaving systems in operation, in accordance with one embodiment of the invention.

FIGS. 3A and 3B illustrate one embodiment of the receiving block 30. As shown, the block can include a generally rectangular-shaped body having a front surface 31*a*, a back surface 31*b*, a top end 31*c*, a bottom end 31*d* and a pair of sides 31*e* and 31*f*.

In one embodiment, the back surface can include a recession 32 having a shape and size that is complementary to the shape and size of the protrusion 11*a*2 of the coupler 11. Additionally, a hole 33 can be positioned through the mounting block so as to extend from the front end 31*a* through the second end 31*b*. The hole 33 can be positioned at a location complementary to the location of the threaded aperture 12, so as to allow mounting bolt 34 to pass through the hole and engage the threaded aperture to secure the block 30 to the first end of the main body 10.

In one embodiment, a pair of threaded openings 35 and 36 can be positioned along the receiving block so as to extend from the top surface 31*c* to the bottom surface 31*d*. Each of the threaded openings can receive alignment bolts 37 which can engage the floor plate 1*c* of the shaving machine 1 as described below.

FIGS. 4-7 illustrate one embodiment of the system 100 in operation. As shown by arrow a, the first end of the coupler 11 can be inserted into the scraping tool receiver 1*a* of a shaving machine 1. The receiver is typically positioned through the shield 1*b* and supported above the floor plate 1*c* of the machine.

Figure 5:
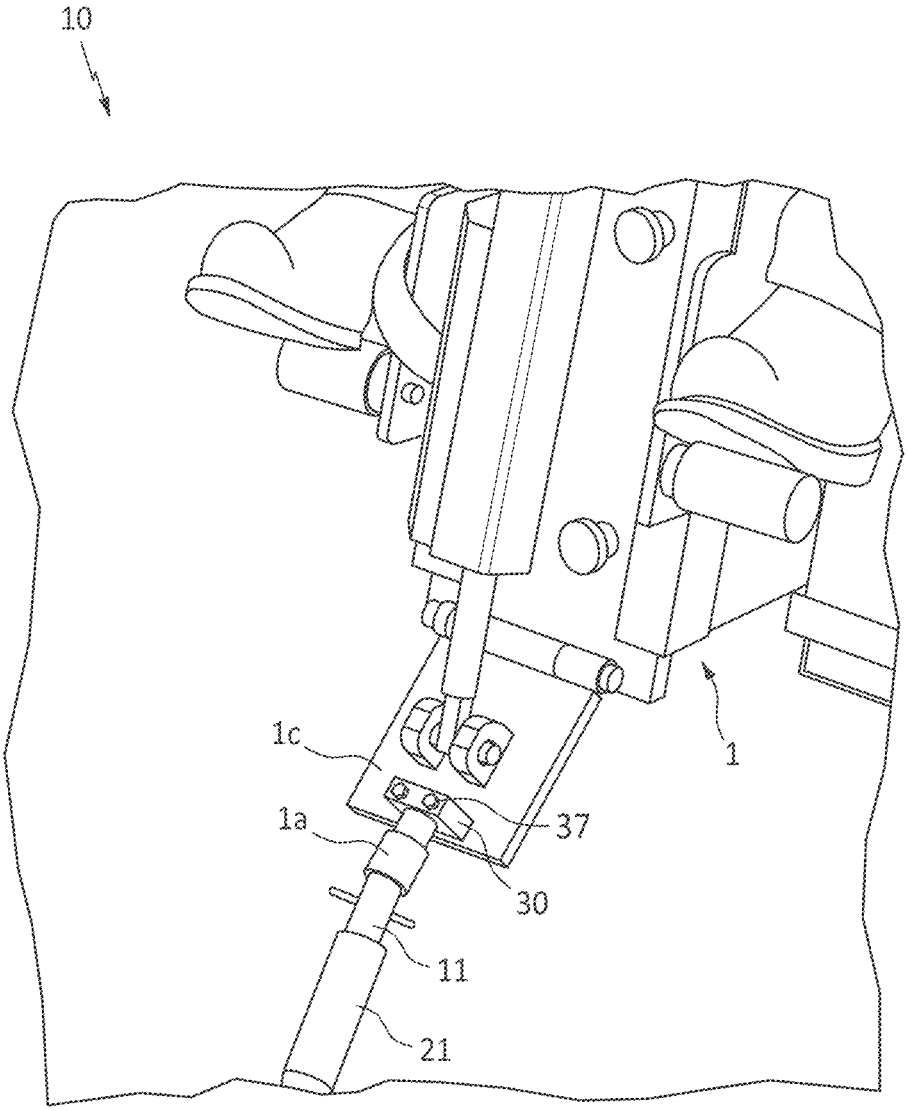
FIG. 5 is a top view of the attachment device for floor shaving systems with the shield removed for ease of illustration, in accordance with one embodiment of the invention.
Figure 6:
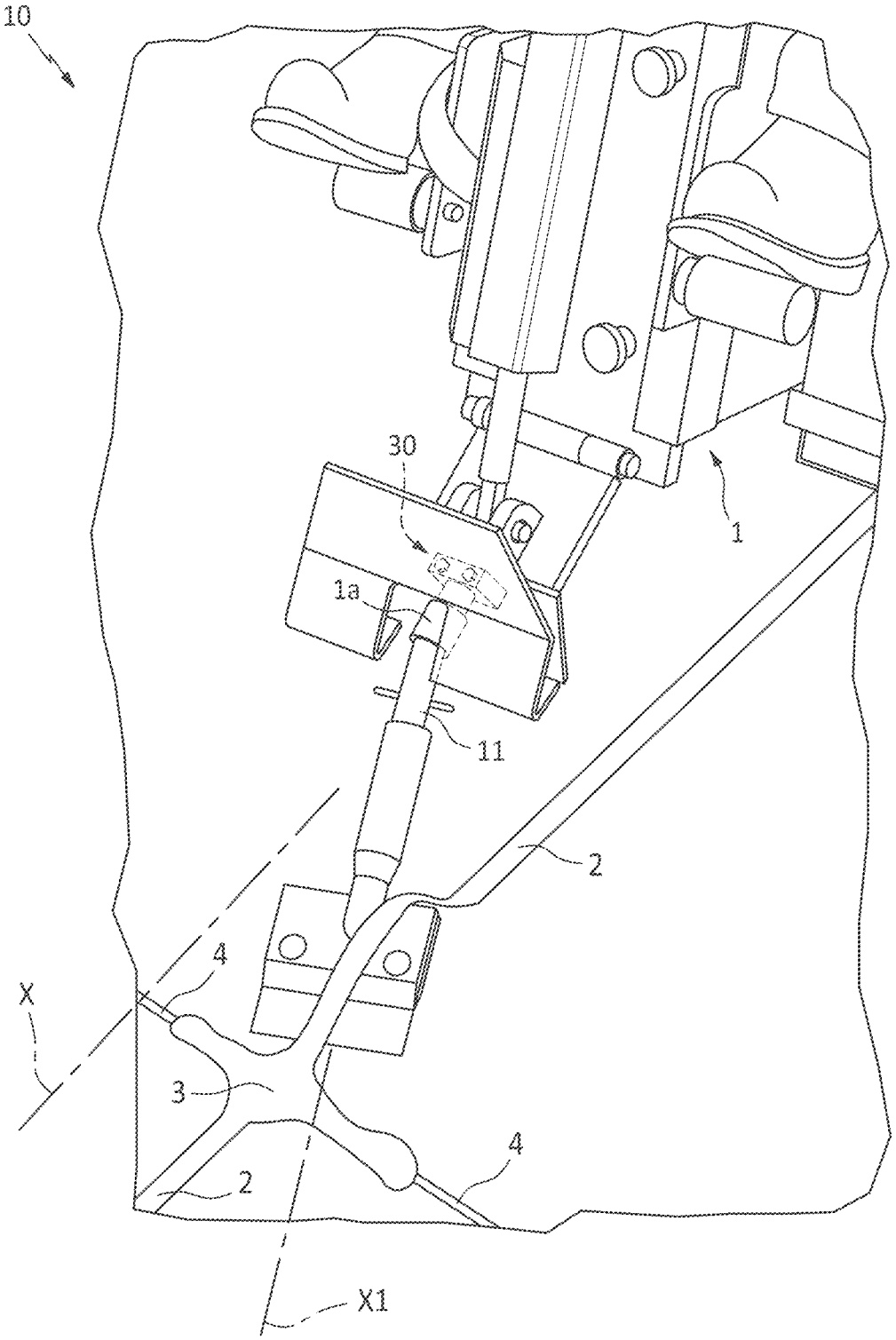
FIG. 6 is a top view of the attachment device for floor shaving systems in operation, in accordance with one embodiment of the invention.

As shown best at FIG. 5, where the shield 1*b* is removed for ease of illustration, the first end of the coupler 11 can be inserted through the tool receiver 1*a* until the pins 13 engage the end of the receiver. When so positioned, the receiving block 30 can be positioned against the first end of the coupler and secured thereto by the bolt as described above. Next, the alignment bolts 37 can be tightened against the floor plate 1*c* to prevent the block from moving. When so positioned, the shaft 5*a* of the scraping tool 5 can be positioned through the opening on the end of the tool receptacle 21 as shown by arrow b.

When installed onto the machine 1, the device 100 of the present embodiment can position the tool 5 at an angle x1 of 11 degrees offset relative to the direction x the machine is traveling. In this regard, the machine can travel the length of a continuous joint 2 with the blade 5*b* scraping and removing the excess filler agent located above the surface of the concrete.

Moreover, as the device approaches an intersection 3 where another joint 4 crosses the first joint 2, the blade will engage the perpendicularly oriented joint diagonally so as to ensure the concrete at the intersection is not damaged, as would occur if the blade were to strike the joint material perpendicularly, as noted above. Such a feature advantageously allows a user to scrape and remove filler agent from concrete floors without having to reposition at each intersection, thus saving enormous time.

Figure 7:
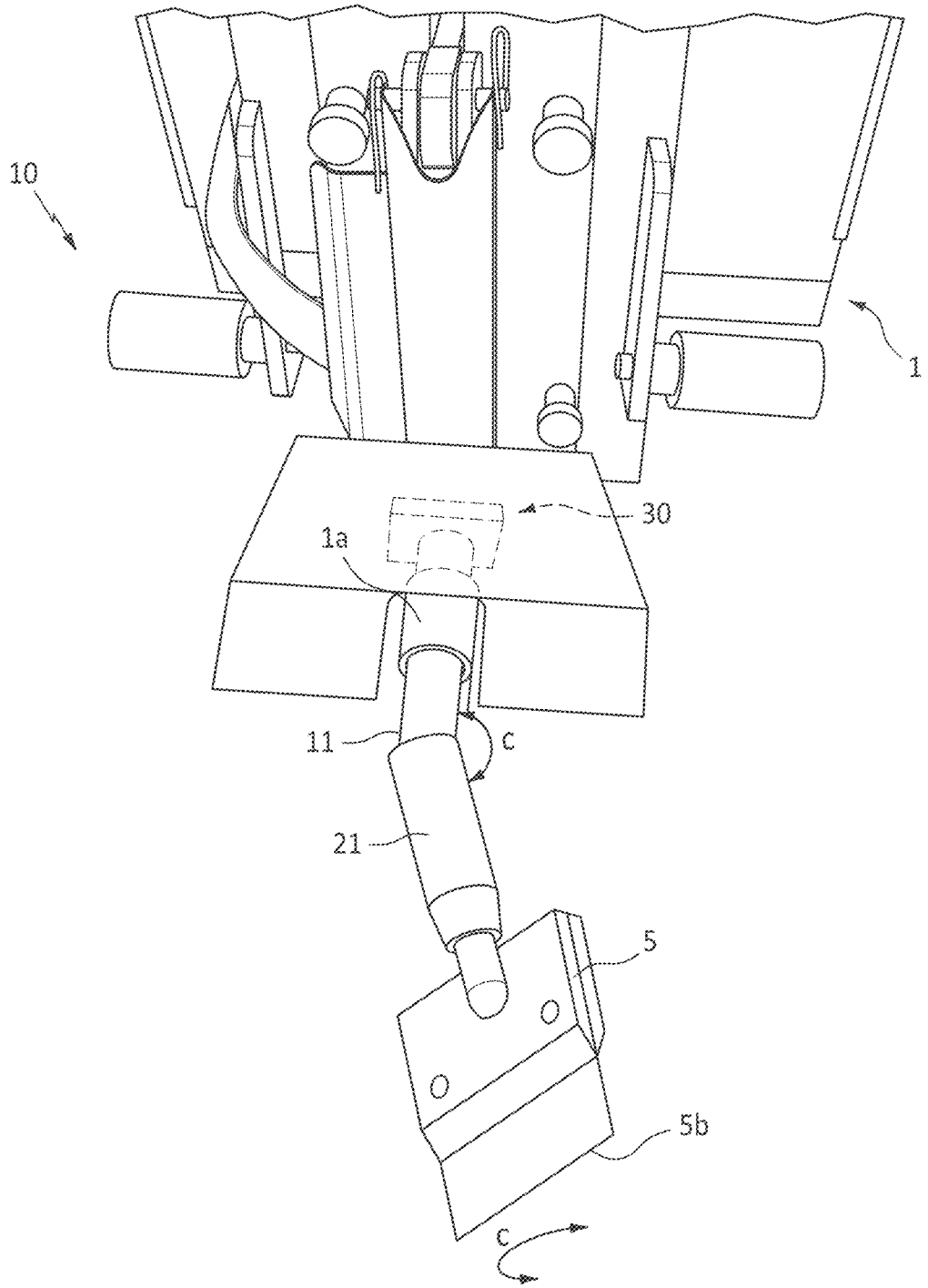
FIG. 7 is another top view of the attachment device for floor shaving systems in operation, in accordance with one embodiment of the invention.

Finally, as shown at FIG. 7, because the scraping tool 5 is connected to the receptacle 21 via a magnet, the tool 5 is able to rotate freely 360 degrees relative to the device 100 as shown by arrow c. Such a feature permits the blade 5*b* to automatically rotate to engage floors at any number of different angles during operation of the machine. Such a feature is critically important as the hydraulics of the machine raise and lower the device because without this ability, the compound angle of the device 100 would prevent the blade edge from being flat with the ground. Additionally, such a feature advantageously allows users to periodically rotate the blade 180 degrees to use both surfaces of the blade edge, thus keeping the blade sharp.

Although different dimensions are contemplated, In the preferred embodiment, the coupler 11 can include (e.g., distance between first end 11*a*, and second end 11*b*) of 120 mm, and the receptacle 21 can include a length (e.g., distance between first end 21*a* and second end 21*b*) of 145 mm. When affected by the 11-degree angle, the result is to position the tool 5 about 250 mm from the receiver 1*a* of the machine 1. Of course, any number of other dimensions are also contemplated.

Although not illustrated, other embodiments are contemplated wherein the device is provided with different mounting assemblies such as different brackets and couplers, for example, so as to permit the device to be utilized with any number of different types and/or brands of shaving machines.

As to a further description of the manner and use of the present invention, the same should be apparent from the above description. Accordingly, no further discussion relating to the manner of usage and operation will be provided.

As described herein, one or more elements of the device 100 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A device, comprising:

a mounting coupler having a first end and a second end;

a tool receptacle having a first end and a second end;

a joint that connects the second end of the mounting coupler to the first end of the tool receptacle; and a receiving block, wherein the first end of the mounting coupler is configured to be positioned through a tool receiver of a floor scraping machine, and wherein the receiving block is configured to engage the first end of the mounting coupler and an inside edge of the tool receiver to secure the mounting coupler to the floor scraping machine.

2. The device of claim 1, wherein the receiving block is secured to the first end of the mounting coupler by a first bolt.

3. The device of claim 1, further comprising:

a pair of fixed pins that extend outward from the mounting coupler.

4. The device of claim 3, wherein the pair of fixed pins are configured to engage an outer edge of the tool receiver when the receiving block is engaged with the first end of the mounting coupler.

5. The device of claim 1, wherein each of the mounting coupler and the tool receptacle are constructed from steel, and the joint comprises a weld.

6. The device of claim 1, wherein the tool receptacle includes an opening along the second end.

7. The device of claim 6, further comprising:

a hollow channel that extends from the opening toward the first end of the tool receptacle.

8. The device of claim 7, wherein the hollow channel includes a shape and a size that is complementary to a shape and a size of a shaft of the scraping tool.

9. The device of claim 8, wherein the scraping tool is removably positioned within the channel.

10. The device of claim 8, further comprising:

a magnet that is positioned within the hollow channel, said magnet functioning to engage and secure the shaft of the scraping tool to the tool receptacle.

11. The device of claim 10, wherein the scraping tool is removably and rotatably positioned within the channel by the magnet.

12. The device of claim 1, wherein the tool receptacle is configured to engage and position a scraping tool at the acute angle relative to a direction of travel of the floor scraping machine.

13. The device of claim 1, wherein the tool receptacle includes a shape and a size that is complementary to a shape and a size of a receiver on the floor scraping machine.

* * * * *